US007222415B2

(12) United States Patent
Kinoshita et al.

(10) Patent No.: US 7,222,415 B2
(45) Date of Patent: May 29, 2007

(54) MANUAL MACHINE FOR ATTACHING AN INSULATION DISPLACEMENT TYPE CONNECTOR

(75) Inventors: Keiichi Kinoshita, Kyoto (JP); Kazuyuki Yamanaka, Higashiosaka (JP)

(73) Assignee: J.S.T. MFG. Co., Ltd., Osaka (JP)

( * ) Notice: Subject to any disclaimer, the term of this patent is extended or adjusted under 35 U.S.C. 154(b) by 433 days.

(21) Appl. No.: 10/941,921

(22) Filed: Sep. 16, 2004

(65) Prior Publication Data

US 2005/0071992 A1 Apr. 7, 2005

(30) Foreign Application Priority Data

Oct. 6, 2003 (JP) ..... 2003-346977

(51) Int. Cl.
*B23P 19/00* (2006.01)
*H01R 13/58* (2006.01)

(52) U.S. Cl. ..... 29/747; 29/748; 29/749; 29/751; 29/755; 29/757; 29/857; 439/470

(58) Field of Classification Search ..... 29/747, 29/749, 751, 757, 854, 856, 748, 752, 861, 29/863; 439/470, 467, 460
See application file for complete search history.

(56) References Cited

U.S. PATENT DOCUMENTS

| | | | | |
|---|---|---|---|---|
| 4,520,558 | A * | 6/1985 | Bunnell | 29/749 |
| 5,745,991 | A * | 5/1998 | Soriano | 29/863 |
| 5,771,574 | A * | 6/1998 | Kato et al. | 29/861 |
| 6,269,538 | B1 * | 8/2001 | Takada | 29/867 |

* cited by examiner

*Primary Examiner*—A. Dexter Tugbang
*Assistant Examiner*—Tai van Nguyen
(74) *Attorney, Agent, or Firm*—Antonelli, Terry, Stout & Kraus, LLP.

(57) ABSTRACT

A manual machine for attaching an insulation displacement connector (10) has housing stoppers (34A,34B) for positioning it on a rest (33), a housing holder (35) for holding the connector on the rest, and a set block (36) disposed near the rest in order to position electric wires (11) at their ends or middle portions. The machine further has a wire holder (37) near the housing holder (35) so as to guide and hold the wires at a given pitch, and a wire stopper (38) pivoted to the set block (36) so as to swivel between an active position close to this block and an idle position remote from it. The wire stopper (38) has a collision portion (61) on which the wire ends (11) will impinge to be aligned one with another, and a biasing portion (63) that will urge the wires' middle portions towards the set block (36).

3 Claims, 15 Drawing Sheets

MANUAL MACHINE FOR ATTACHING AN INSULATION DISPLACEMENT TYPE CONNECTOR

FIELD OF THE INVENTION

The present invention relates to a manual machine for attaching an insulation displacement type connector to portions of a plurality of electric wires so as to form a wire harness, and more particularly relates to such a machine that an operator will manually place in a body of said machine both the wire portions and the connector, in order to subsequently establish an electric connection between said wires and said connector.

PRIOR ART

Wire harnesses of this structure are classified into the end type and the daisy chain type. Each insulation displacement type connector forming the end type harnesses is fixed on either or both of opposite wire ends. In contrast, each daisy chain type harness comprises a plurality of such connectors all secured to middle portions intermediate between the wire ends. Certain manual machines known in the art are useable to manufacture any harnesses, whether end type or daisy chain type.

FIGS. 12 and 13 shows one of the prior art manual machines that comprises a positioning device 1 for setting in place wire portions and an insulation displacement connector. The operational mode shown in FIG. 12 is for manufacture of the end type harnesses, with the other mode shown in FIG. 13 being for manufacture of the daisy chain type harnesses.

The positioning device 1 incorporated in a machine body (not shown) is capable of sliding therein. As will be seen in an exploded perspective view of FIG. 14, this device comprises a base plate 2 driven to reciprocate between its inoperative home position and its working position for attaching the insulation displacement type connector. The positioning device 1 further comprises a connector rest 3 fixed on the base plate 2, and a housing stopper 4 for positioning the connector 10 (see FIGS. 15(*a*) and 15(*b*)) supported on the rest 3. The device still further comprises a housing holder 5 for pressing the connector 10 against an upright top barrier of the connector rest 3 so as to hold the connector in place. A set block 6 disposed adjacent to the rest 3 is a further element of device 1 such that a plurality of wires 11 (see FIGS. 15(*a*) to 16(*b*)) may be positioned, selectively with respect to their ends or with respect to their middle portions. A wire holder 7 as a still further element is disposed adjacent to the housing holder 5. The wires 11 to be attached to the connector will be guided and held in place, while being arranged side by side at a prescribed given pitch.

A set screw 8 serves to fix the housing stopper 4 on the connector rest 3. Every connector 10 then lying on the rest 3 will have its side bearing against the stopper 4, thus taking a correct transverse position.

A holder guide 12 is fixed on the base plate 2, in such a state that the housing holder 5 retained by this guide can slide relative thereto towards and away from the connector rest 3. Springs 14 intervening between the guide 12 and its cover 13 do urge the holder 5 towards the rest, as seen in FIGS. 15(*a*) and 15(*b*). The connector 10 lying on the connector rest 3 will thus be pushed to the upright top barrier so as to be held in place on this rest. A cam shaft 15 transversely penetrates the holder guide 12, and a lever 16 protrudes perpendicularly from the side end of this shaft.

This lever 16 will be operated to rotate the shaft 15 about its axis, when the housing holder 5 has to be retracted a distance from the upright top barrier of the rest 3. At such a releasing position of housing holder 5, the connector 10 then lying on this rest 3 is ready for removal therefrom.

The wire holder 7 consists of two notched plates 17 and a spacer 19 interposed between them. Each notched plate has the series of comb-like indentations 18 for arranging the wires at the given pitch, with further set screws 8 fixing this wire holder on the housing holder 5.

The set block 6 comprises a wire guide 20 and a wire stopping plate 24 disposed at the rear end of this block. The wire guide 20 has an upright fore wall 21 whose upper end extends along and in alignment with the frontal face of the guide 20, and an oblique rear wall 22 tapered down and towards the back face of said guide. A plurality of guiding grooves 23 are formed in and along a summit where the upright fore wall 21 and oblique rear wall 22 intersect one another. Those grooves 23 and the indentations 18 of wire holder 7 are arranged at the same pitch, and the wire stopping plate 24 faces these grooves. Such a set block 6 is of a versatile nature, enabling manufacture of either wire harness, end type or daisy chain type.

In a case of making the end type harnesses, the set block 6 will be secured to the connector rest 3 so as to take a position as shown in FIGS. 12, 15(*a*) and 15(*b*). In this state, the front face of set block 6 is adjoined to the rear face of the rest 3. An insulation displacement type connector 10 laid on this rest will then be pressed with the housing holder 5, not to be rickety. A plurality of wires 11 will subsequently be guided each through one of the indentations 18 of wire holder 7 and the corresponding one of guiding grooves 23 of set block 6. These wires 11 thus pushed into engagement with said indentations and grooves are arranged side by side at the given pitch. Forward extremities of said wires thus arranged are kept in a neat and snug contact with the stopping plate 24. The positioning device 1 incorporated in the machine body and taking this position will subsequently be forwarded to an insulation displacing station. At this station shown in FIGS. 15(*a*) and 15(*b*), a punch 25 having been resting right above the connector 10 will be driven downwards so that the wires 11 are forced into the connector to thereby establish an electric connection. During this step, the upright fore wall 21 of wire guide 20 constituting the set block 6 will function as a cutter blade cooperating with the punch 25. Forward ends 11' of the wires 11 extend forwards from the connector 10 are excessive forward lengths of said wires. Therefore, the punch 25 and the wall 21 as the blade will sever them off simultaneously with the insulation displacement step as detailed above. Waste 11' produced from such trimmed wires 11 will slip off the oblique rear wall 22, for automatic disposal.

In another case of making the daisy chain type harnesses, the set block 6 will be secured to the connector rest 3 so as to take another position as shown in FIGS. 13, 16(*a*) and 16(*b*). In this state, the rear face of set block 6 is adjoined to the rear face of the connector rest 3. The wire guide 20 stands away therefrom by a remarkable distance, with the wire stopping plate 24 having been removed. Similarly to the first case of making the end type harnesses, an insulation displacement type connector 10 laid on this rest 3 will then be pressed with the housing holder 5, not to be rickety. Also similarly to the first case, a plurality of wires 11 will subsequently be guided each through one of the indentations 18 of wire holder 7 and the corresponding one of guiding grooves 23 of set block 6. However, each wire 11 extends a remarkable distance beyond the groove 23. The positioning device 1 incorporated in the machine body and taking this position will subsequently be forwarded to the insulation displacing station. At this station shown in FIGS. 16(*a*) and 16(*b*), the punch 25 having been resting right above the connector 10 will be driven downwards so that middle portions of the wires 11 are forced into the connector 10 to thereby establish electric connection.

The prior art machine may be switched over from its mode of manufacturing the end type harnesses to its mode of manufacturing the daisy chain type harnesses, or vice versa. In such a case, the set block 6 should be repositioned with the front side back, or with the back side front. In addition, the stopping plate 24 should also be dismounted or remounted, thus rendering very intricate and unefficient the rearrangement of constituent members in such a prior art machine.

SUMMARY OF THE INVENTION

An object of the present invention made in view of this problem is therefore to provide a manual machine for attaching an insulation displacement type connector such that any work for changing or rearranging its parts is not necessitated even when end type harnesses are to be made in place of daisy chain type ones, or vice versa.

Another object is to protect the insulation displacement type connector from taking any erroneous or wrong position when a sure and reliable electric connection is established using such a manual machine.

In order to achieve these objects, a manual machine provided herein for attaching an insulation displacement type connector does comprise a base plate incorporated in a machine body and capable of sliding therein to reciprocate between an inoperative home position and a working position for attaching the connector. The manual machine further comprises a connector rest fixed on the base plate, and a housing stopper for positioning the connector lying on the rest. The machine still further comprises a housing holder for pressing the connector against the connector rest so as to hold the connector in place. A set block disposed adjacent to the rest is a further element of the machine such that a plurality of wires may be positioned selectively with respect to their free ends or with respect to their middle portions. A wire holder as a still further element is disposed adjacent to the housing holder, so that the wires to be attached to the connector will be guided and held in place, while being arranged side by side at a prescribed given pitch. Characteristically, the manual machine of the invention further comprises a wire stopper that is pivoted to the set block so as to swivel between an active position close to the set block and an idle position remote therefrom. The wire stopper has a collision portion on which the wires will impinge at their free ends to be aligned one with another, and a biasing portion that will urge the wires at their middle portions towards the set block.

Preferably, the collision portion may be formed as an array of flat wall zones of a front face of the wire stopper. Each wall zone is defined between adjacent two of notches carved side by side at the given pitch in the front face. This feature will enable a surer positioning of the wire free ends.

Also preferably, the housing stopper may be composed of a fixed shoe and a movable shoe so that the connector or connectors laid on the connector rest are protected from becoming out of order in position in the direction of the given pitch. The fixed shoe is secured to one of opposite side ends of the connector rest, with the movable shoe facing the fixed one and capable of sliding along a front face of the set block. The movable shoe may comprise a vertical ear protruding therefrom for selective engagement with one of vertical grooves that are formed side by side at the given pitch in the set block front face. In this case, the movable shoe can be set at any desired incremental position, correspondingly to the number of poles of the connector, that is the number of the wires to be forced into the connector.

In operation, the wire stopper pivoted to the set block will swing between its active and idle positions, towards or away from the set block. Any parts need no longer be changed or rearranged when manufacture of end type harnesses is switched over to manufacture of daisy chain harnesses, or vice versa, affording efficient production thereof The free ends of electric wires forming an end type harness will merely be pushed to the collision portion of wire stopper then taking its active position, without trimming and aligning said free ends of the wires prior to insulation displacement attachment to a connector. However in case of making a daisy chain harness, the wire stopper is retracted to its idle position before the wire holder will guide and hold the wires side by side at a given pitch. Subsequent to this step, the wire stopper will be shifted to its active position where its biasing portion urges the middle portions of said wires towards the set block. Thus, the connector can efficiently be attached to the wire middle portions in the manner of insulation displacement.

A more precise positioning of the wire ends will be afforded, if the machine as set forth in the accompanying claim 2 is used to manufacture end type harnesses.

Error in position of the connector lying on the rest will be diminished in the direction of the pitch, if the machine as set forth in claim 3 is used to manufacture the harnesses of either type. Thus, any imperfect attaching of the connectors to the wires in the insulation displacement fashion will surely be avoided.

BRIEF DESCRIPTION OF THE DRAWINGS

FIG. 7(*b*) is another scheme of the positioning device shown in its state of just attaching the connector;

FIG. 7(*c*) is still another scheme of the positioning device shown in its further state of having attached the connector to the wire ends;

FIG. 11(*b*) is another scheme of the positioning device shown in its state that the connector is just being attached;

FIG. 11(*c*) is still another scheme of the positioning device shown in its further state that the connector has been attached to the middle portions of wires;

FIG. 15(*b*) is another scheme of the positioning device shown in FIG. 15(*a*), but in its state of just attaching the connector;

FIG. 16(*b*) is another scheme of the positioning device shown in FIG. 16(*a*), but in its state of just attaching the connector.

THE PREFERRED EMBODIMENTS

Now an embodiment of the present invention will be described referring to the accompanying drawings.

Figure 1:
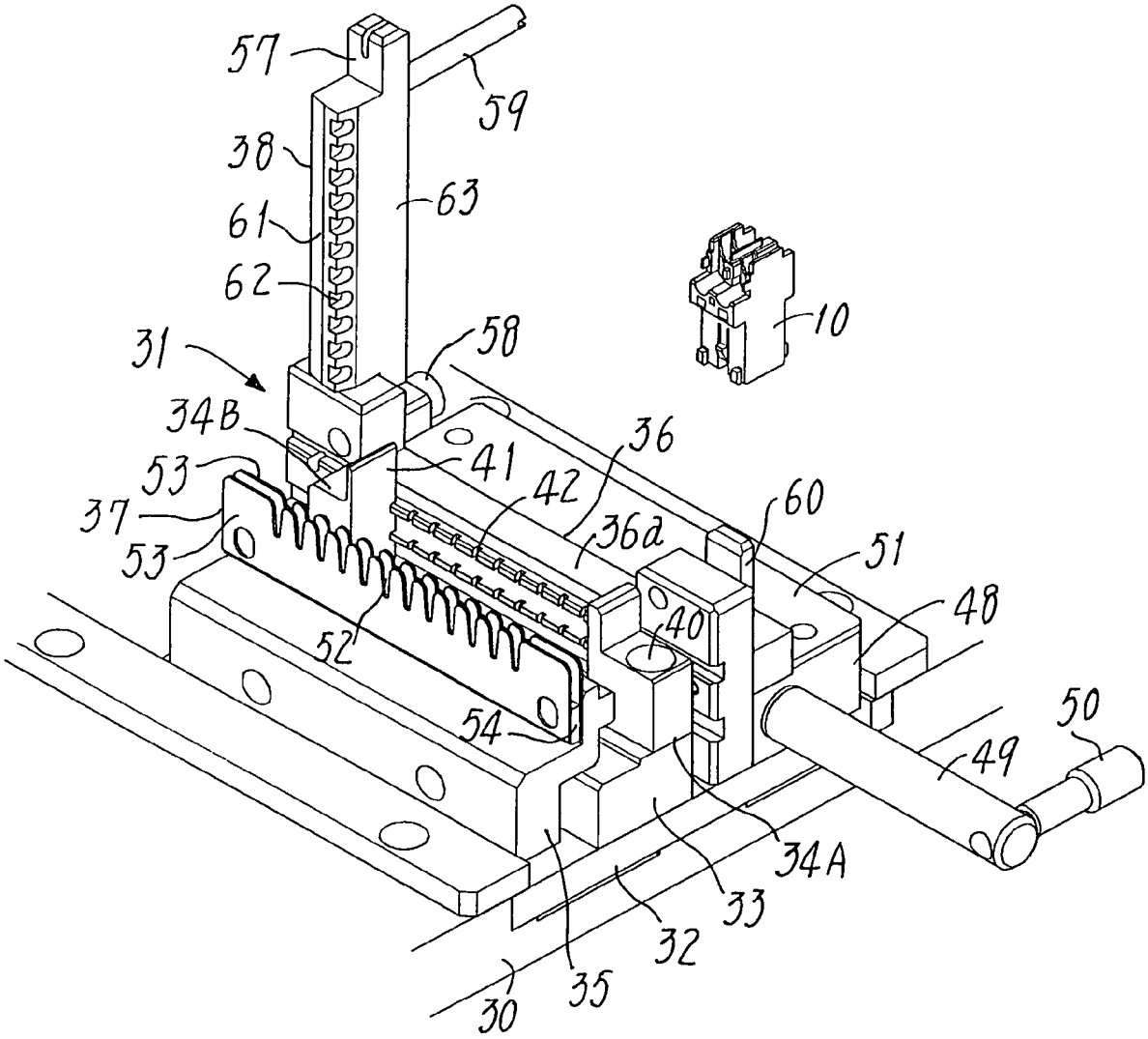
FIG. 1 is a perspective view of a positioning device as the principal part of a manual machine provided herein for attaching insulation displacement type connectors one by one.

FIG. 1 shows the machine body 30 of a manual machine for attaching to wires an insulation displacement type connector. A connector positioning device 31 mounted on the machine body is in its inoperative home position, ready to start to position the wires 11 relative to the connector 10. The machine body 30 comprises a pneumatic press or a hand press not detailed here but driving a punch 25 (see FIGS. 7(*a*) to 7(*c*)) up and down at a working position of said device.

Figure 2:
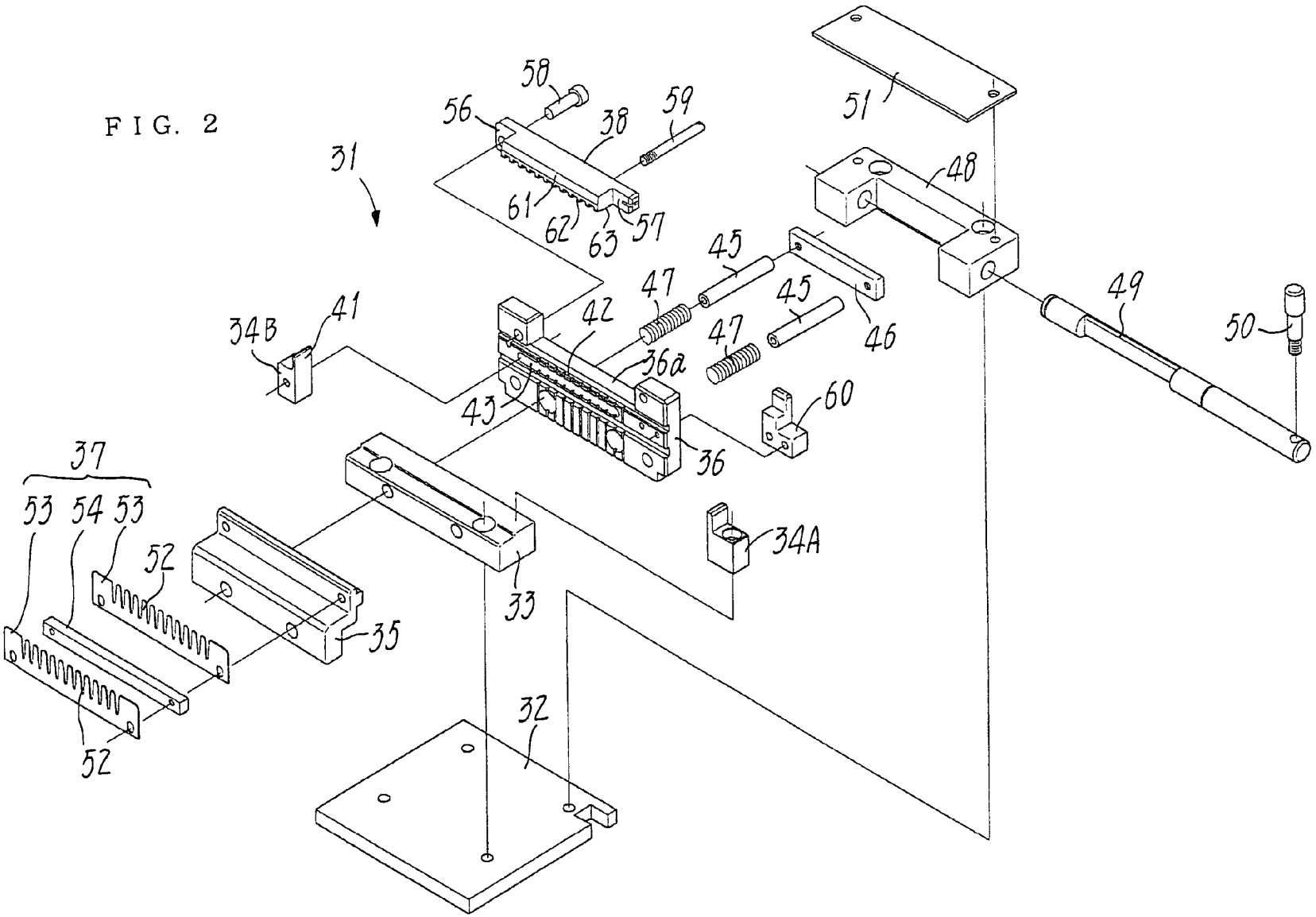
FIG. 2 is an exploded perspective view of the positioning device.

As shown in an exploded state in FIG. 2, the positioning device 31 mounted on the machine body 30 is capable of sliding thereon. This device 31 comprises a base plate 32 movable between its inoperative home position and its working position, a connector rest 33 fixed on the base plate, and a pair of shoes 34A and 34B of a housing stopper for positioning the connector lying on the rest 33. The positioning device 31 further comprises a housing holder 35 for pressing the connector 10 against the connector rest 33 so as to hold the connector in place. A set block 36 disposed adjacent to the rest is a further element of the device, and a wire holder 37 as a still further element is disposed adjacent to the housing holder 35. This wire holder 37 is designed such that the wires 11 to be attached to the connector will be guided and held in place, while being arranged side by side at a given pitch (viz., the pitch at which the contacts in the connector 10 are arranged). The positioning device still further comprises a wire stopper 38 that is a versatile member used in both the cases of making end type harnesses or daisy chain type harnesses, as will be detailed below.

Figure 3:
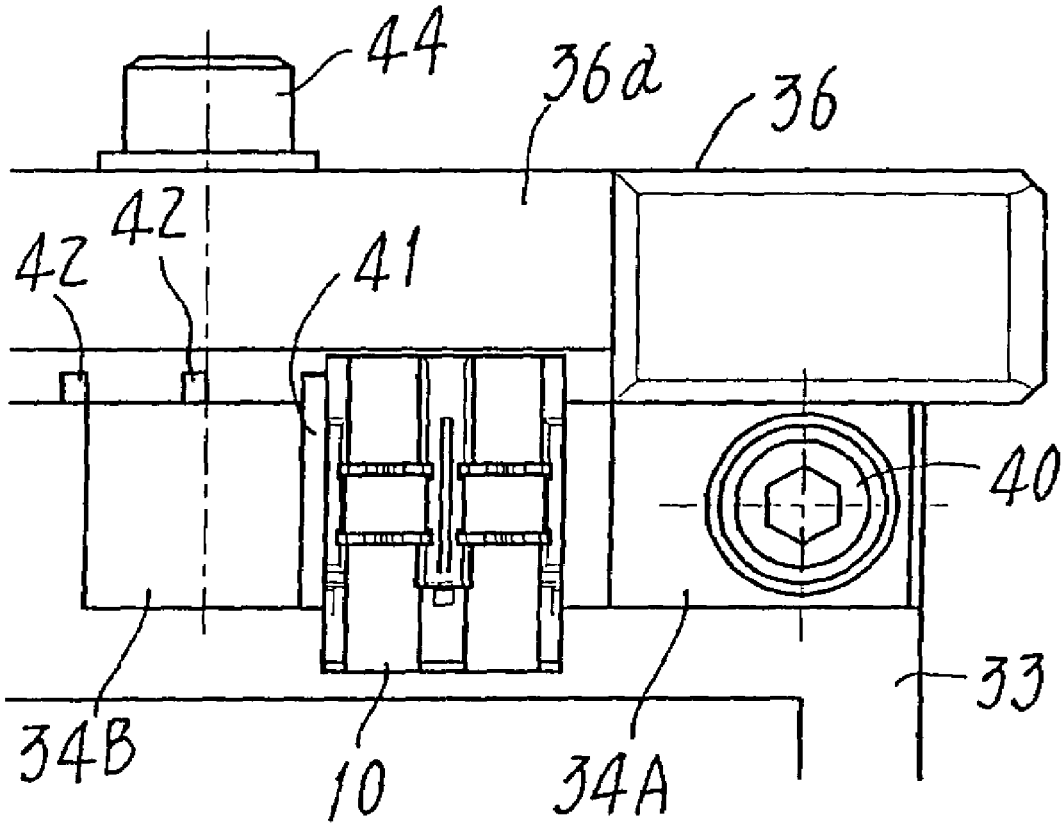
FIG. 3 is an enlarged plan view of connector-positioning members included in the positioning device.

One of the shoes of housing stopper 34A is a fixed stopper secured by a set screw 40 to one of side regions of the connector rest 33, as is shown in FIGS. 1 and 3. The other shoe of housing stopper 34B is a movable stopper facing the fixed shoe 34A and capable of sliding on the rest 33 and along the front face of set block 36. A vertical ear 41 protrudes from the side of movable shoe 34B facing the fixed shoe 34A, so as to serve as a positioning means for the movable shoe. An array of parallel vertical grooves 42 formed in the front face of the set block 36 are arranged at a certain pitch corresponding to the wire holder 37. An elliptic aperture 43 (see FIG. 2) penetrating the set block 36 fore and aft does extend transversely to receive a set bolt 44. As seen in FIG. 3, the connector 10 (of the two-pole type having two contacts as exemplified in the drawings) to be attached will be laid on the rest so as to bear against the fixed shoe 34A. Then, the movable shoe 34B will be moved towards fixed shoe so that they firmly grip the connector between them. The vertical ear 41 of movable shoe will thus fit in one of the vertical grooves 42 that is remote from the fixed shoe a distance corresponding to the number of poles of the connector. The set bolt 44 inserted through the elliptic aperture 43 is then fastened to rigidly secure the movable shoe 34B to the set block 36, thus firmly fixing the connector 10 on the connector rest 33.

Figure 7:
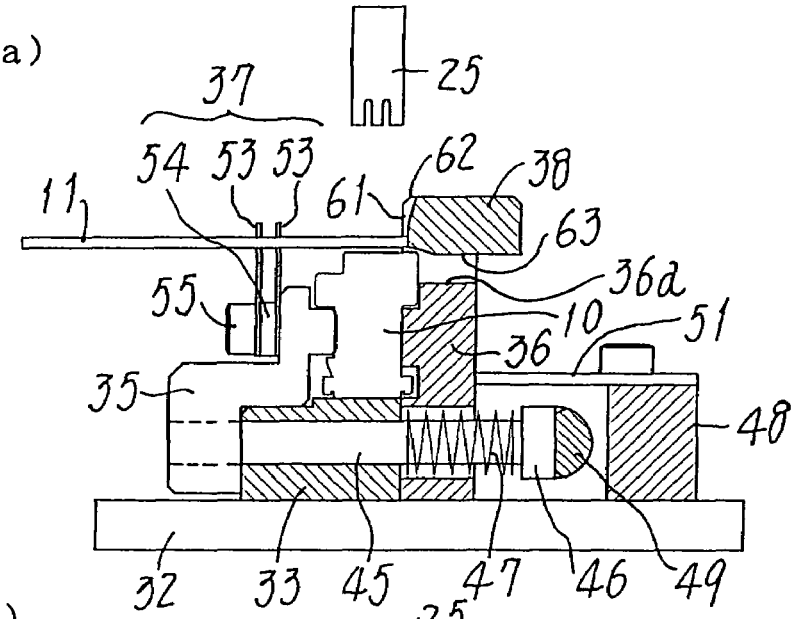
FIG. 7(*a*) is a scheme of the positioning device having moved to its working position to be ready for the insulation displacement attaching of the connector to the wire ends.
Figure 7:
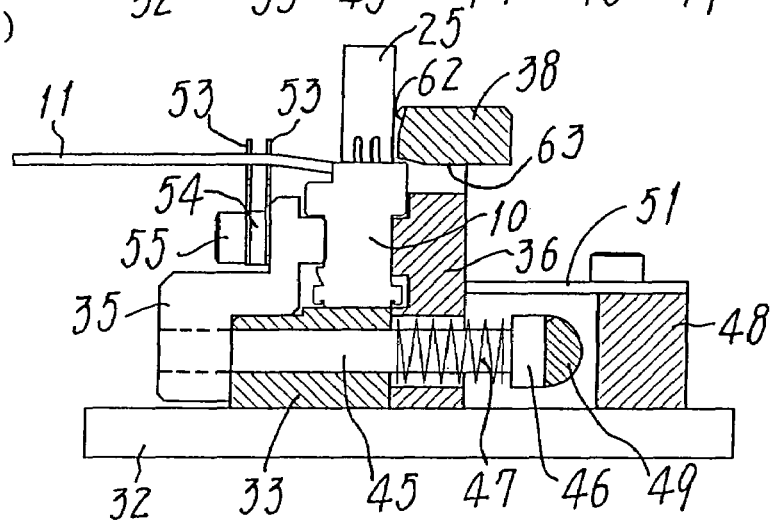
Figure 7:
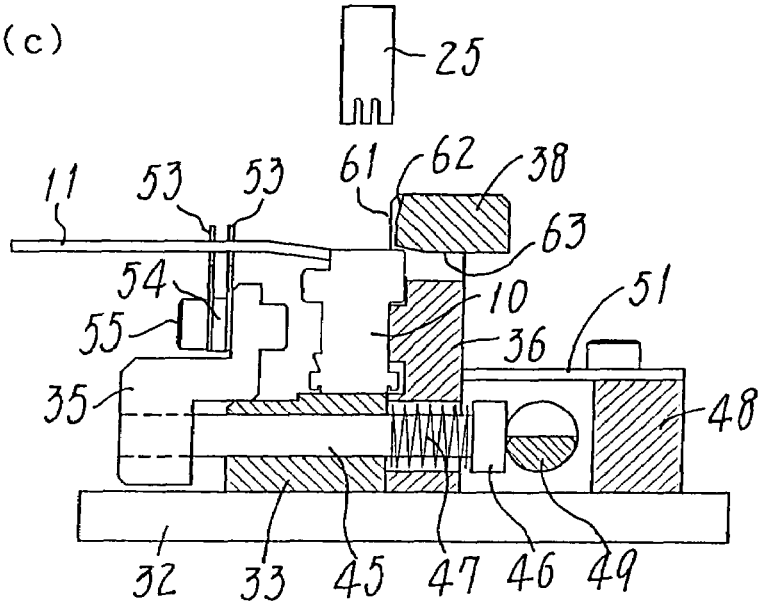
Figure 8:
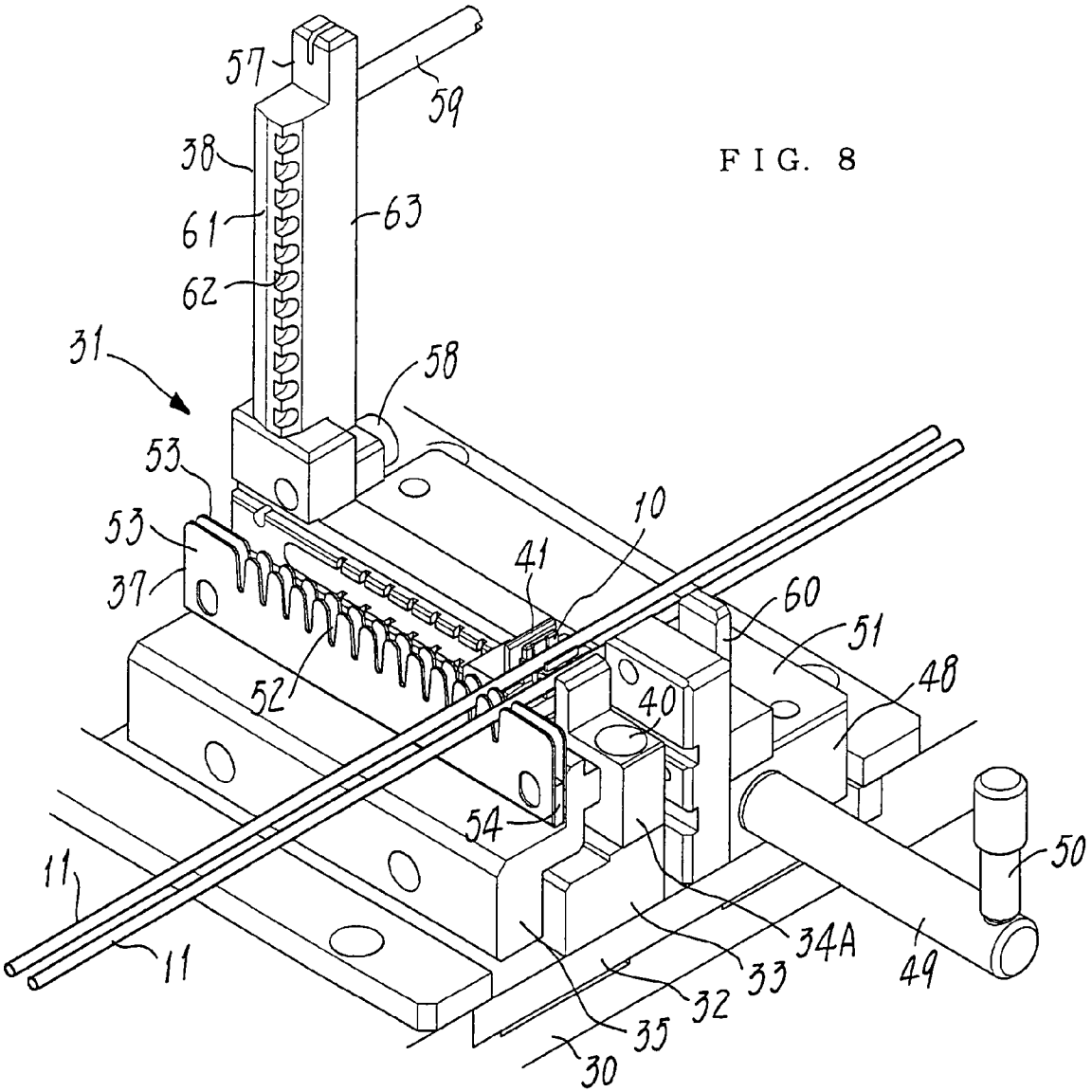
FIG. 8 is a perspective view of the positioning device, in which the wires have been set in place relative to a connector that has to form a daisy chain type harness.

As will be seen from FIGS. 2 and 7(*a*) to 7(*c*), the housing holder 35 is fixed to one ends of a pair of actuator rods 45 extending and sliding through both the connector rest 33 and set block 36. The other ends of actuator rods 45 are connected one to another by a cam follower plate 46. Springs 47 loosely fitted on the actuator rods 45 between the connector rest 33 and follower plate 46 do always urge elastically the housing holder 35 into a forced contact with the rest 33. On the other hand, a guide holder 48 is fixed on the base plate 32, and a cam shaft 49 inserted transversely through the guide holder can rotate about its own axis. In operation, a lever 50 attached to the free end of this shaft 49 will be used to rotate it an angle of 90 degrees. If and when the cam follower plate 46 is caused to take a position as shown in FIG. 7(*c*), the actuator rods 45 will be displaced longitudinally against the springs 47. As a result, the housing holder 35 is pushed away from the connector rest 33 so as to take a releasing position. A lid 51 covers the guide holder 48.

The wire holder 37 is composed of two parallel plates 53 and a spacer 54 interposed between them. Each plate has a row of indentations 52 each defined between adjacent comb-like teeth of the plate, such that the wires 11 will be held side by side at the given pitch. Set screws 55 (see FIGS. 7(*a*) to 7(*c*)) firmly connect the wire holder 37 to the housing holder 35.

The wire stopper 38 is generally of the shape of a square column whose ends are cut out to form flanges 56 and 57. One of the flanges 56 is pivoted by a pin 58 to one end of the rear wall of set block 36, with a manual lever 59 attached to the other flange 57. This lever will be operated to shift the wire stopper from its active position near the top face 36*a* of set block 36 to its idle position remote from the top face 36*a*, or vice versa. A bracket 60 fixed on the other end of the rear wall of set block 36 will support the flange 57 of the wire stopper 38 then standing at its active position.

The front face of wire stopper 38 is formed as a collision portion 61, with the bottom face of this stopper being formed as a biasing portion 63. In operation, the collision portion 61 will come close to the top of connector 10 positioned on the rest 33 when the wire stopper takes its active position. Consequently, the wires 11 forming an end type harness will have their free ends abutting this portion 61. In detail, notches 62 are carved in the front face of stopper 38 so that they are arranged side by side at the same pitch as that at which the contacts in connector 10 are arranged. The collision portion 61 is a continuous integration of flat regions each defined between the adjacent two notches 62. However, the biasing portion 63 at the active position will face the top 36*a* of set block 36 so that middle portions of wires 11 forming a daisy chain harness are biased towards the top 36*a*.

Wire harnesses may be produced using the present positioning device 31 mounted on a machine body 31, in the following manner.

Figure 4:
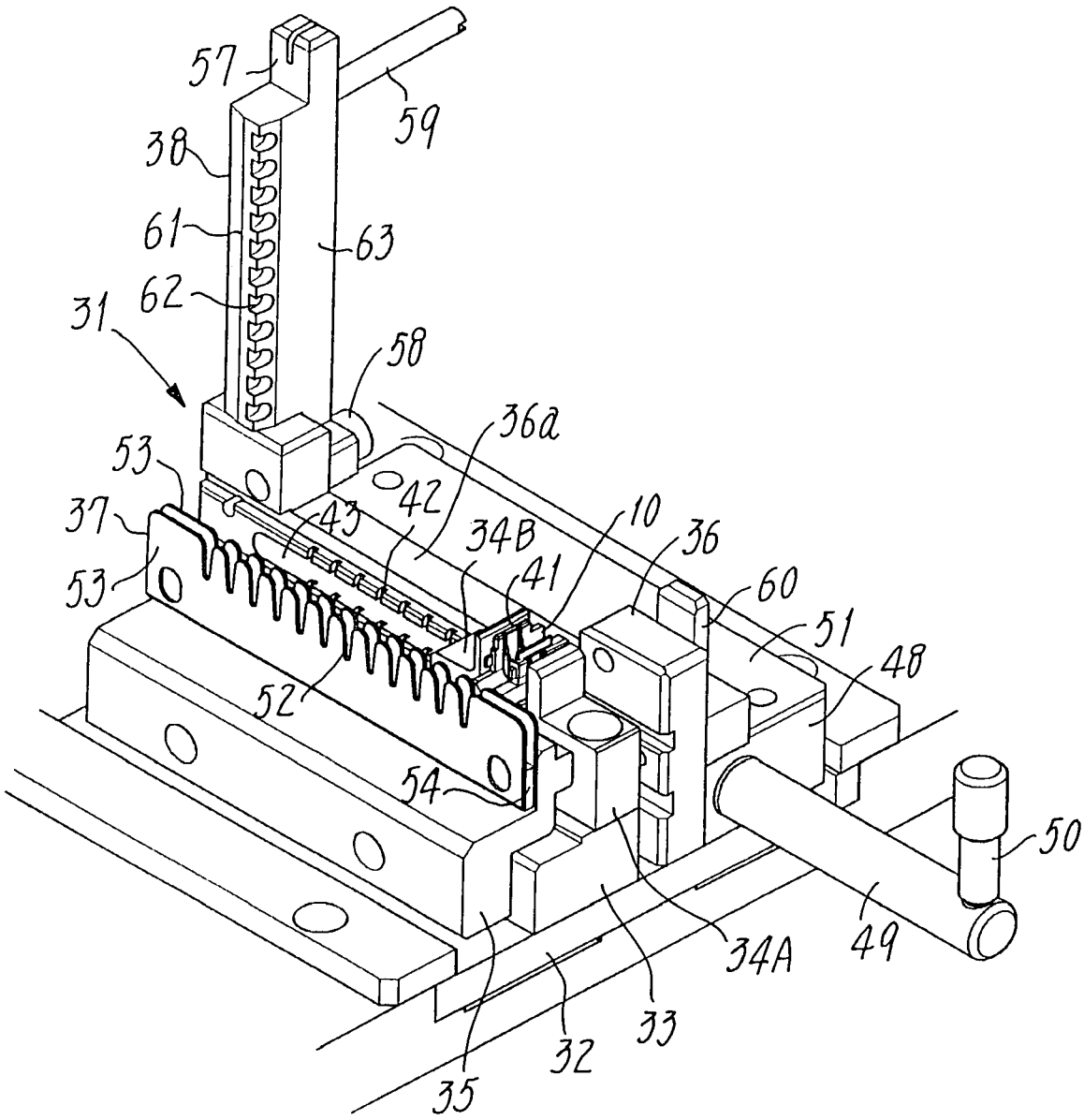
FIG. 4 is a perspective view of the positioning device in an operational state for holding the connector in place.

At first, the wire stopper 38 will be retracted to its idle position as shown in FIGS. 3 and 4, and a connector 10 will be set in place on the connector rest 33.

Figure 5:
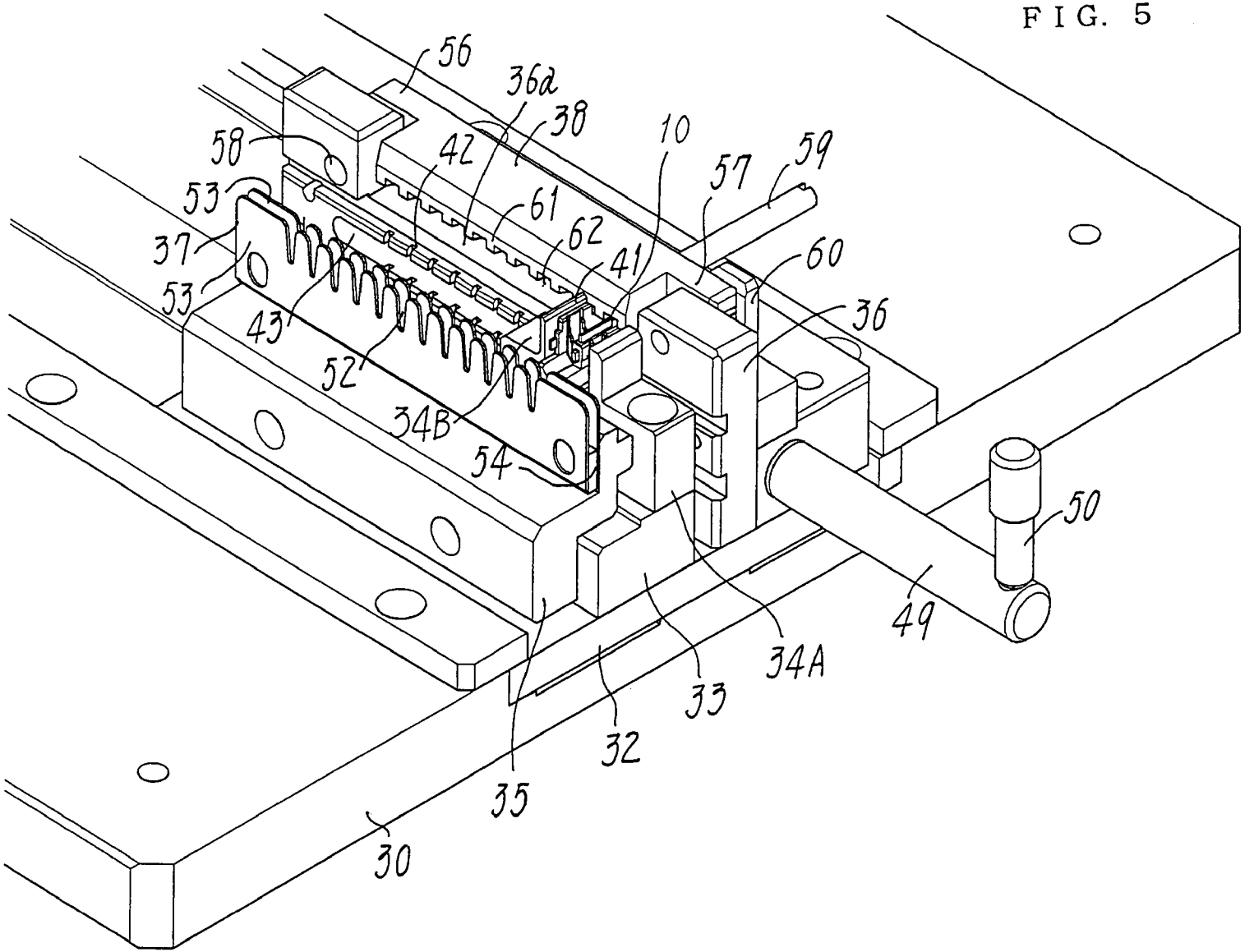
FIG. 5 is a perspective view of the positioning device, in which a wire stopper as one of constituent parts thereof is at its active position ready to operate.
Figure 6:
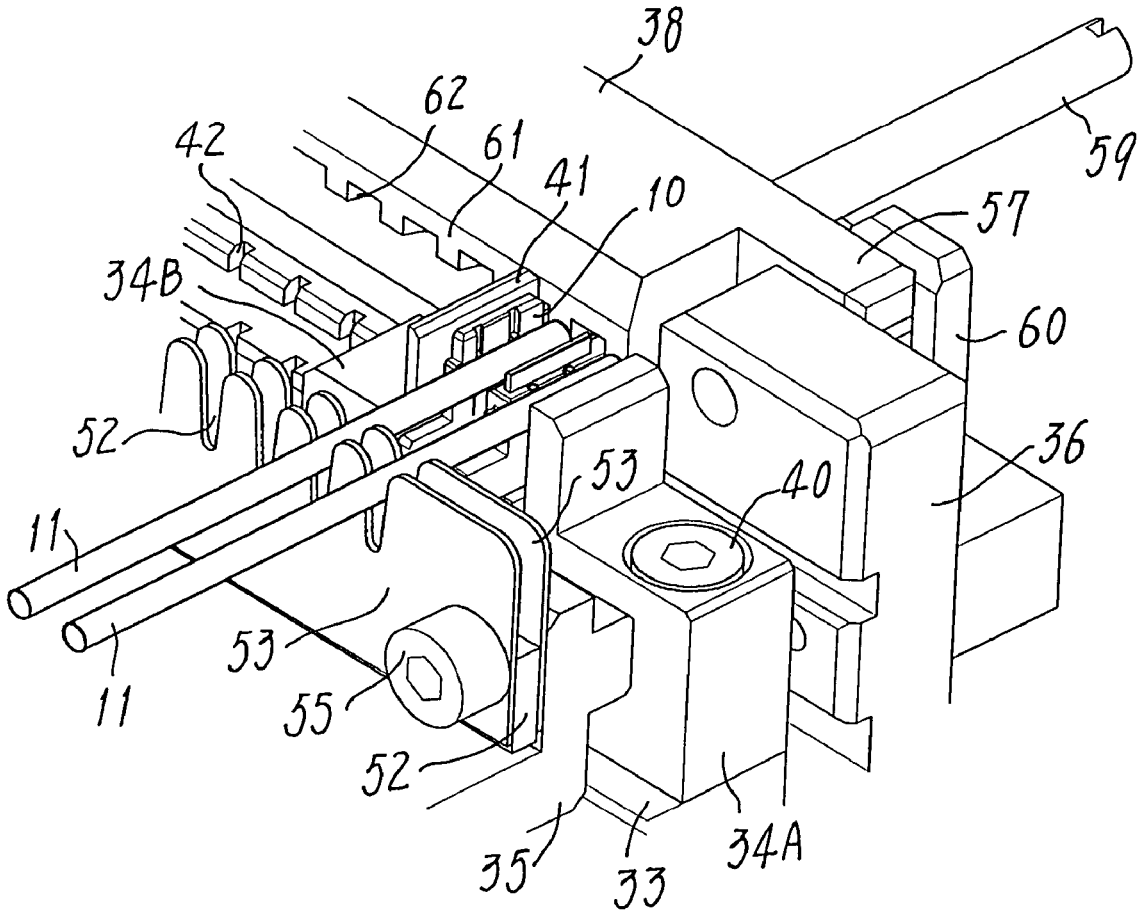
FIG. 6 is an enlarged and fragmentary perspective view of the positioning device, in which wire ends for forming an end type harness have been set in place.

In case of making an end type wire harness, the wire stopper 38 will be shifted to its active position supported by the bracket 60 as shown in FIGS. 5 and 6. Free ends of a plurality of electric wires (two wires in the drawings) 11 will then be caused to abut the flat regions between the notches 62 in the wire stopper collision portion 61. On the other hand, the indentations 52 formed in the parallel plates 53 of wire holder 37 will firmly receive the wires' portions near the free ends so as to arrange them at the given pitch.

Subsequently, the manual lever 50 will be used to move the positioning device 31 to a pressing station in the machine body 30. At this station, the connector 10 stands right under a pressing punch 25 built in machine body as shown in FIG. 7(*a*). This punch 25 will then be driven downwards so that the wires 11 are pressed into the connector 10 as shown in FIG. 7(*b*) to thereby establish an electric connection. None of the wire free ends 11 kept in contact with the collision portion 61 during this step need not be trimmed thereafter.

After having pressed the wires 11 into the connector, the punch 25 will be lifted away from the positioning device 31. The lever 50 will then be swiveled to cause the cam shaft 49 to rotate an angle of 90 degrees about its axis as shown in FIG. 7(*c*). Consequently, the follower plate 46 forces back the actuator rods 45 against the springs 47. The connector holder 35 thus removed away from the connector rest 33 will make free the connector 10. Next, the wire stopper 38 is returned to its idle position (see FIG. 1) so that the thus assembled end type harness can be taken off the connector rest 33.

Now, FIGS. 8 to 11(*c*) will be referred to with respect to a case of making a daisy chain type harness.

Similarly to the making of the end type harness, the wire stopper 38 will be retracted at first to its idle position as shown in FIGS. 3 and 4. The connector 10 will then be set in place on the connector rest 33.

Figure 9:
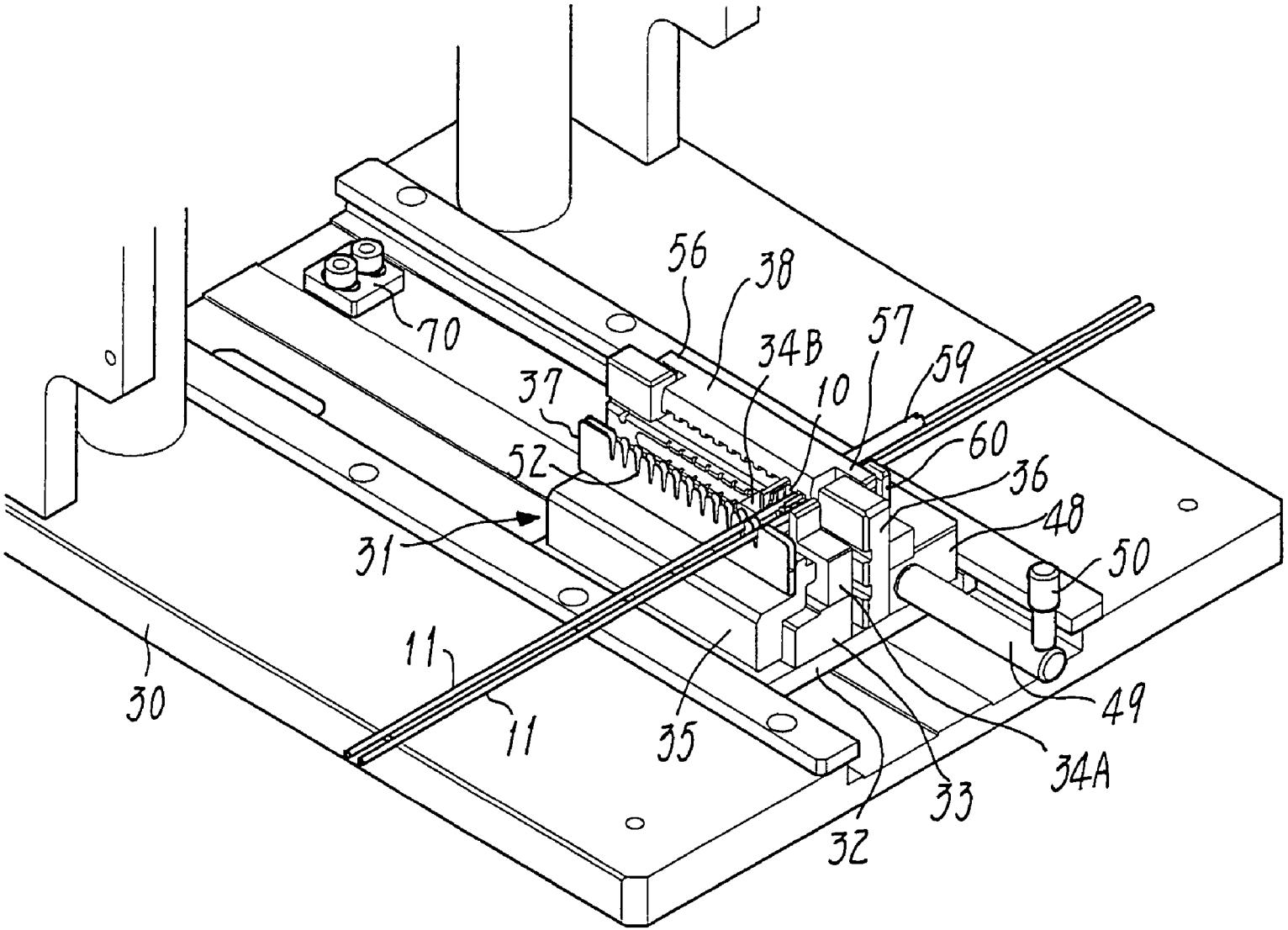
FIG. 9 is a perspective view of the positioning device, in which the wire stopper is at its active position, subsequent to thee step shown in FIG. 8.

The middle portions of wires 11 will subsequently be positioned above the indentations 52 of the plates 53 of wire holder 37 so as to be pressed therein at the given pitch. As seen in FIG. 9, the wire stopper 38 then taking its active position will be supported in place at its flange 57 engaging with the bracket 60. The biasing portion 63 formed as the bottom face of this stopper 38 will urge downwards the wires' middle portions extending rearwards over the connector 10. Thus, such middle portions biased towards the top 36*a* of set block 36 are immovably set in place.

Figure 11:
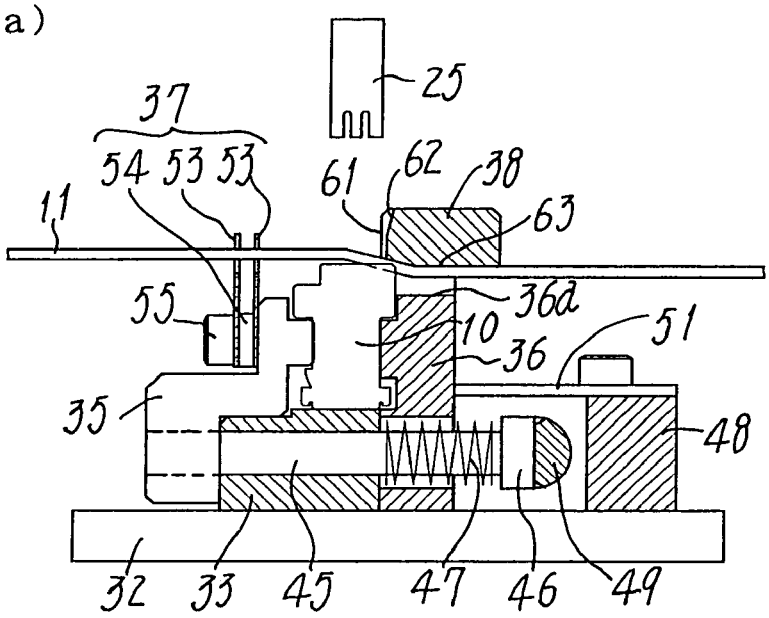
FIG. 11(*a*) is a scheme of the positioning device having moved to its working position to be ready for the insulation displacement attaching of the connector to the middle portions of wires so as to manufacture the daisy chain harness.
Figure 11:
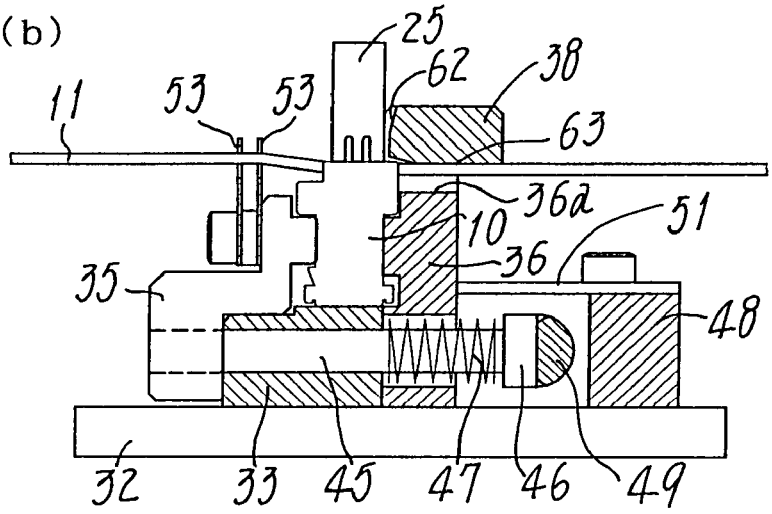
Figure 11:
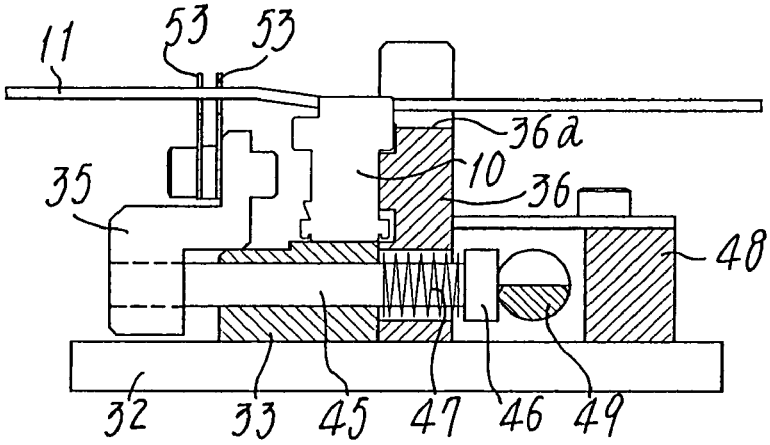
Figure 12:
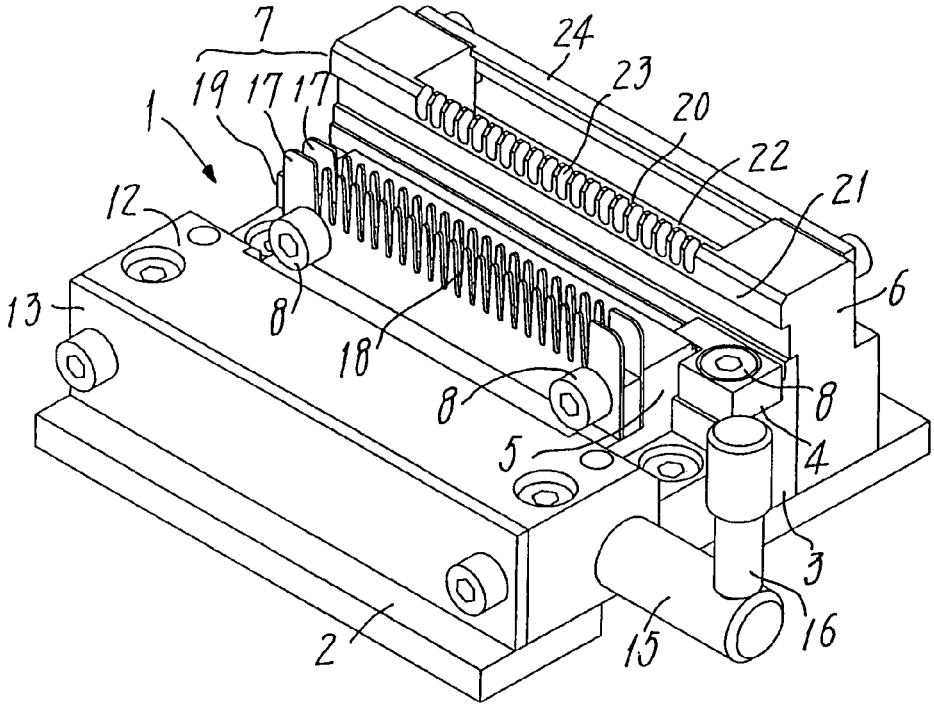
FIG. 12 Prior Art
FIG. 12 is a perspective view of the prior art manual machine for attaching an insulation displacement type connector, in which its positioning device is being used to manufacture end type harnesses.
Figure 13:
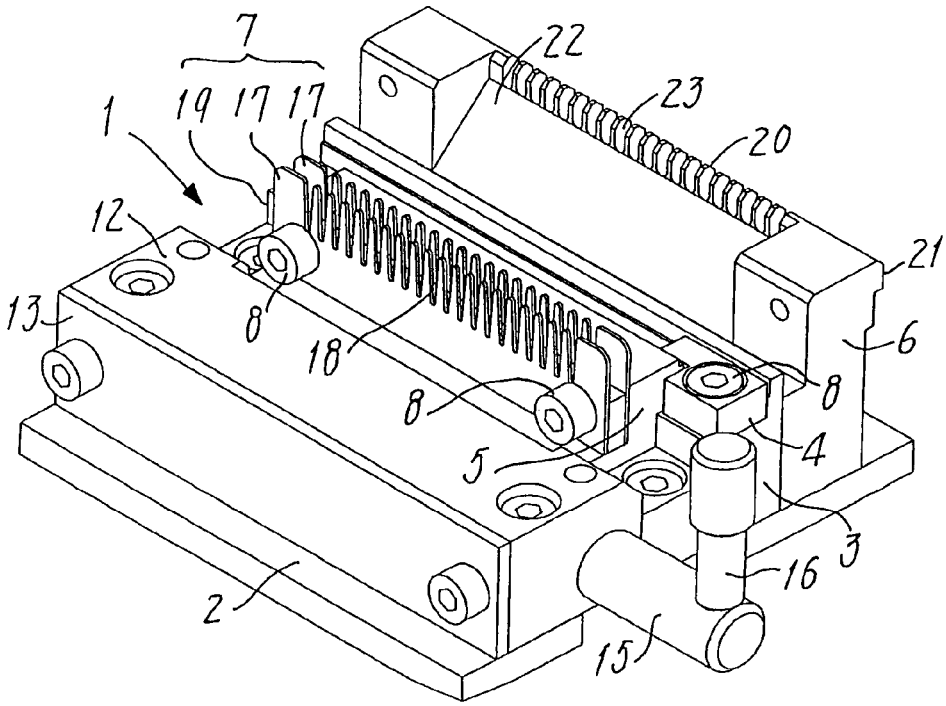
FIG. 13 Prior Art
FIG. 13 is a perspective view corresponding to FIG. 12, in which the positioning device is being used to manufacture daisy chain type harnesses.
Figure 14:
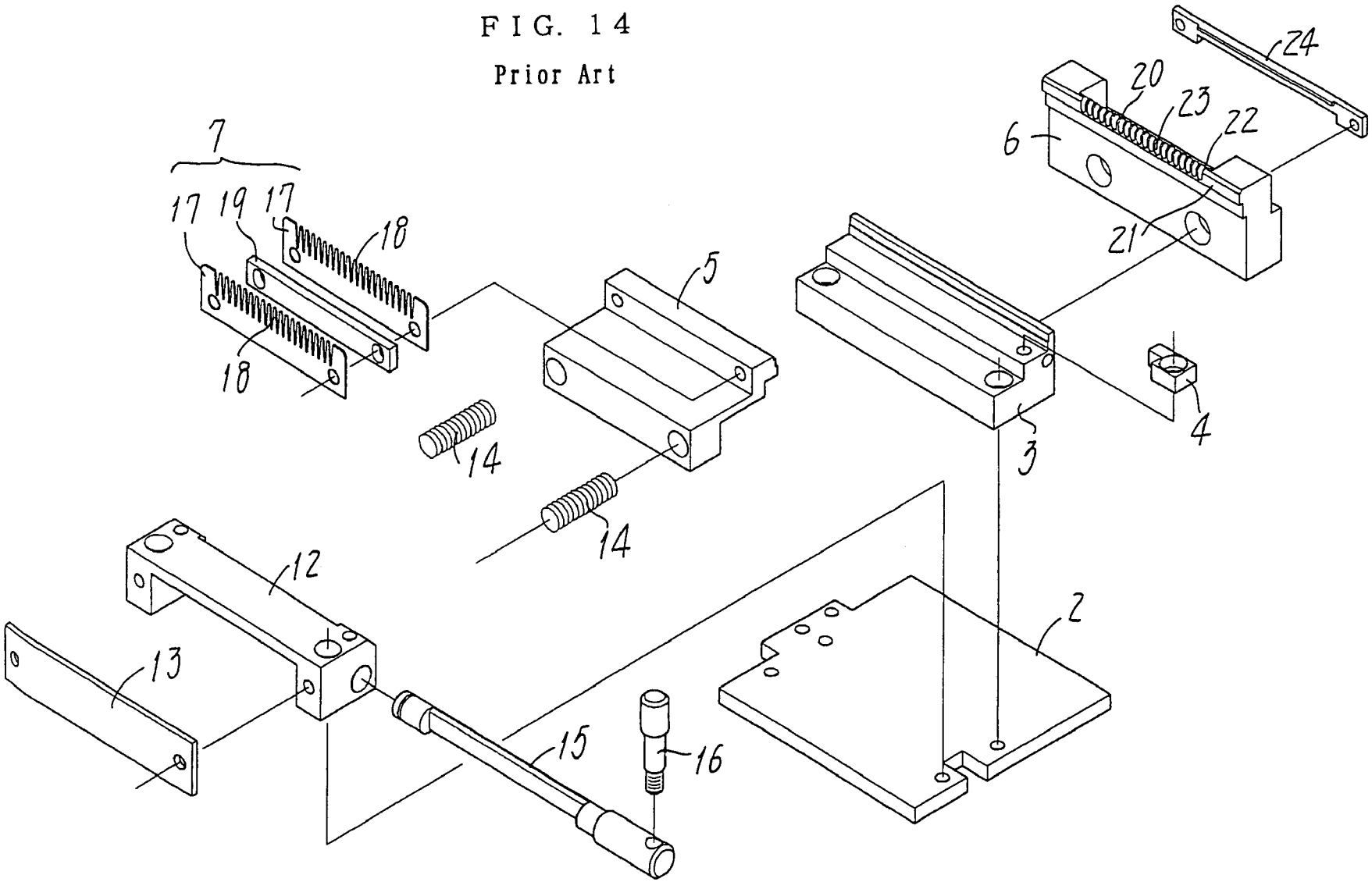
FIG. 14 Prior Art
FIG. 14 is an exploded perspective view of the positioning device in the prior art machine.
Figure 15:
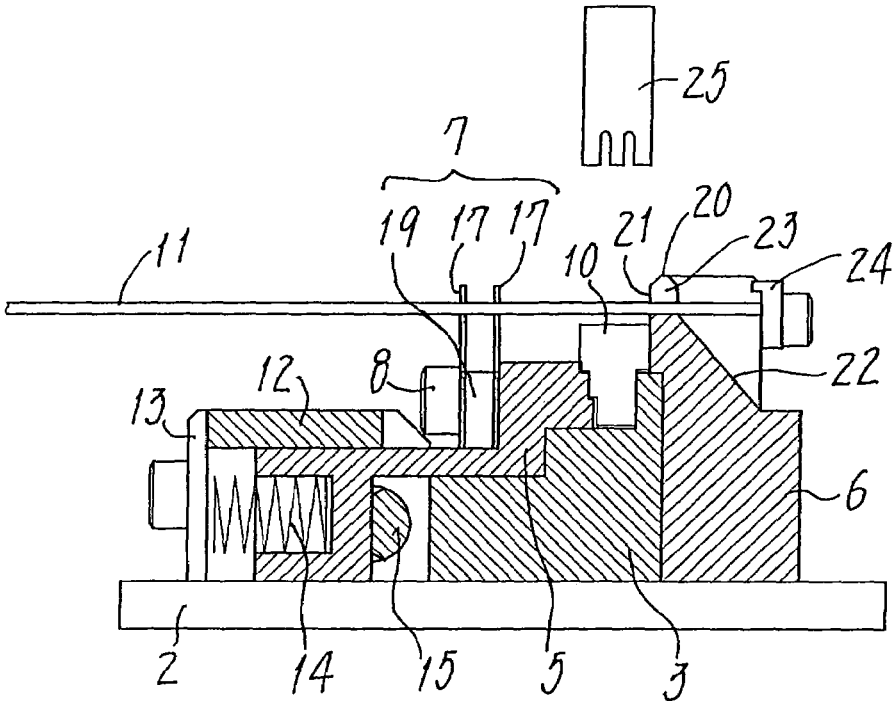
FIG. 15 (a) Prior Art
FIG. 15(*a*) is a scheme of the prior art positioning device having moved to its working position to be ready for the insulation displacement attaching of the connector to the wire ends.
Figure 15:
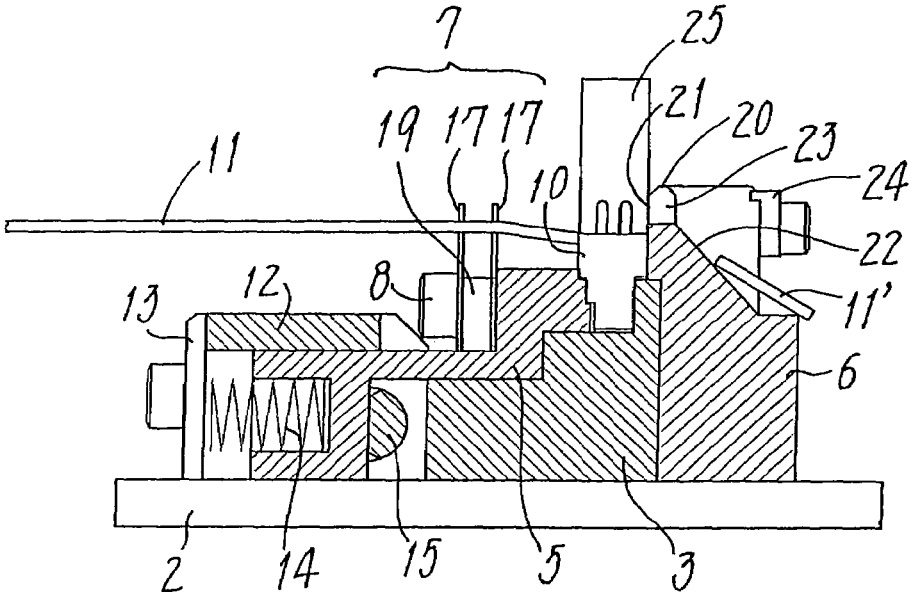
FIG. 15 (b) Prior Art
Figure 16:
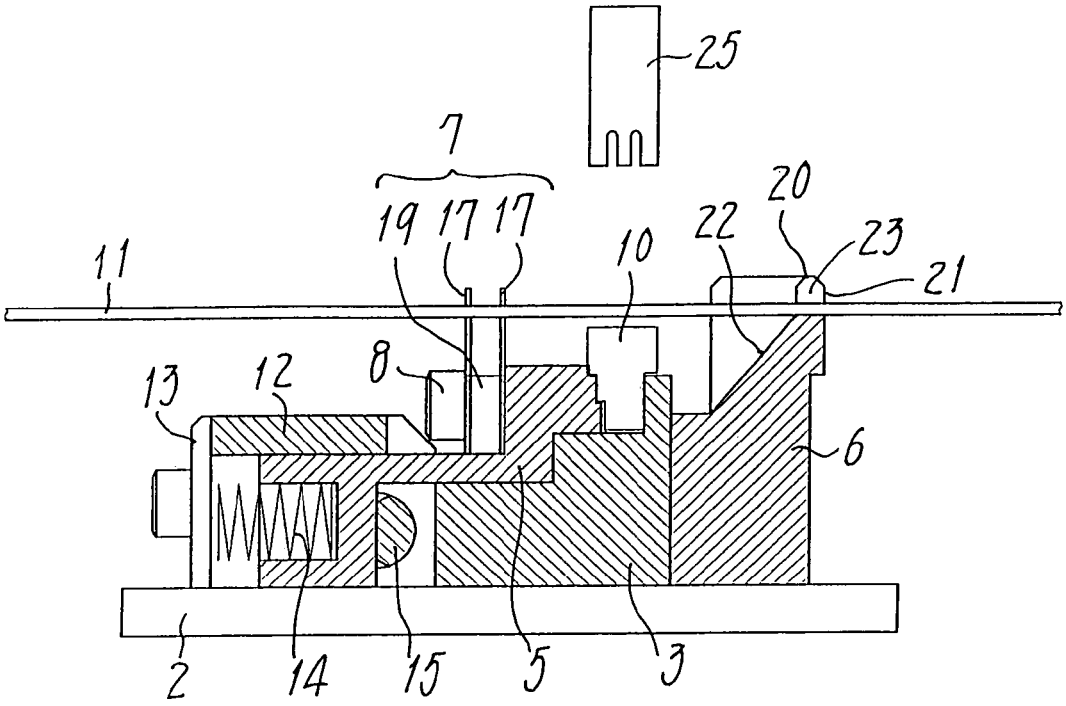
FIG. 16 (a) Prior Art
FIG. 16(*a*) is a scheme of the prior art positioning device having moved to its working position to be ready for the insulation displacement attaching of the connector to the middle portions of the wires.
Figure 16:
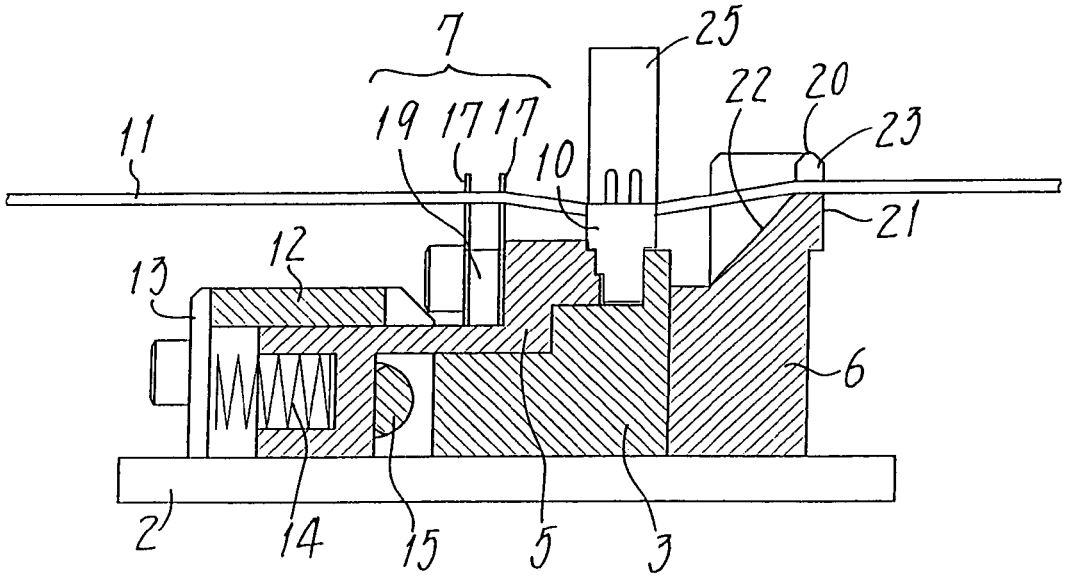
FIG. 16 (b) Prior Art

Subsequently, the manual lever 50 will be used to move the positioning device 31 to contact a stopper 70 (see FIG. 9) so as to shift to the working position in the machine body 30. At this position, the connector 10 stands right under a pressing punch 25 built in machine body as shown in FIG. 11(*a*). This punch 25 will then be driven downwards so that the wires 11 are pressed into the connector 10 as shown in FIG. 11(*b*) to thereby establish an electric connection.

Figure 10:
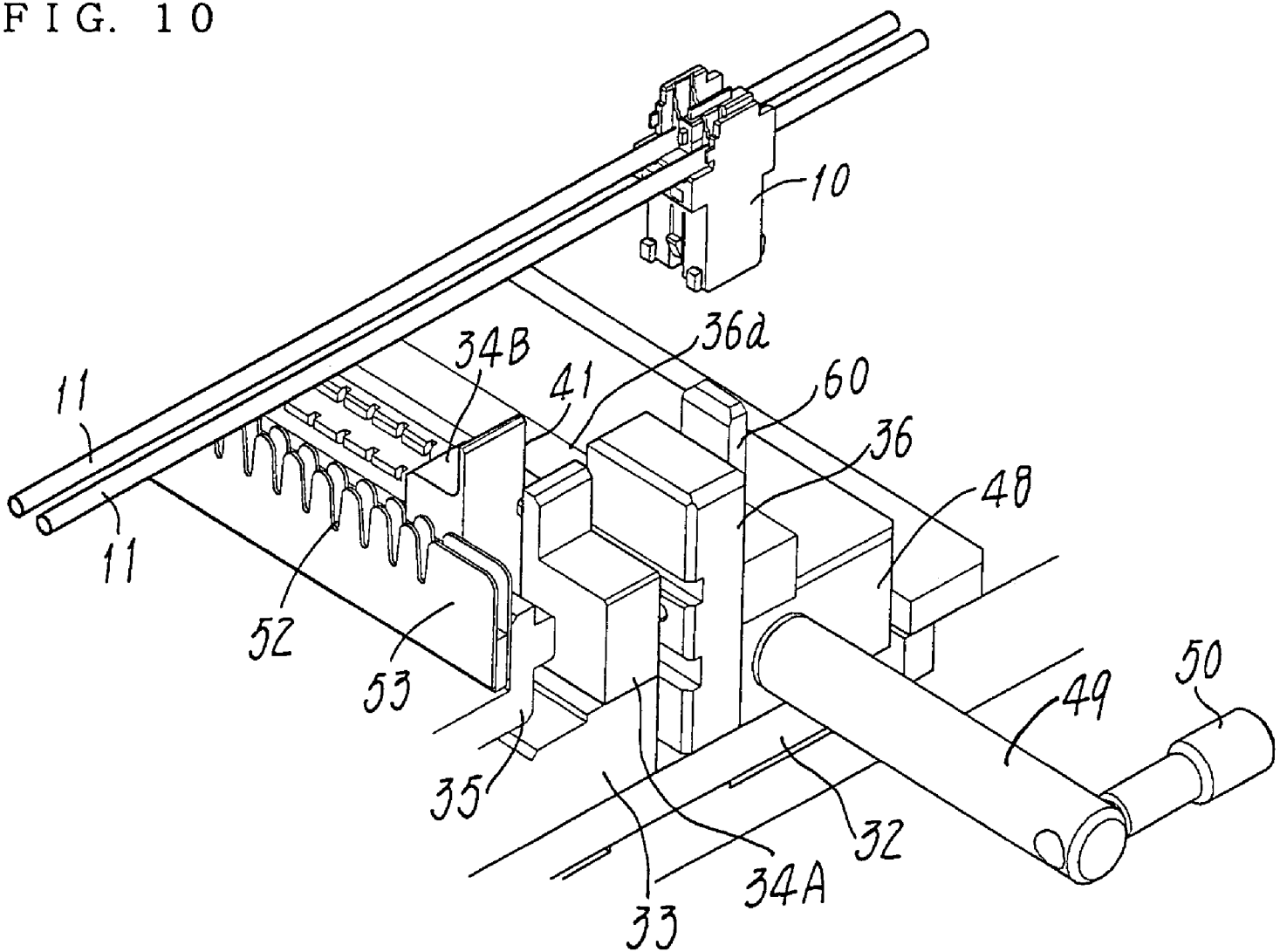
FIG. 10 is a perspective view of the positioning device, with the daisy chain type harness just being removed therefrom.

After having pressed the wires 11 into the connector, the punch 25 will be lifted away from the positioning device 31. The lever 50 will then be swiveled to cause the cam shaft 49 to rotate an angle of 90 degrees about its axis as shown in FIG. 11(*c*). Consequently, the follower plate 46 forces back the actuator rods 45 against the springs 47. The connector holder 35 thus removed away from the connector rest 33 will make free the connector 10. Next, the positioning device 31 is returned to its inoperative home position and the wire stopper 38 is retracted to its idle position (see FIG. 1). The thus assembled daisy chain type harness can be taken off the connector rest 33, as seen in FIG. 10. Although FIG. 10 illustrates an example in which the sole connector is attached to the middle portions of two wires 11 to form a harness, it will be understood readily by those skilled in the art that more than two wires can successively be secured to more than two connectors one after another so as to form a wire harness of the daisy chain type.

It will now be apparent that the manual machine of the invention is useful to efficiently produce any of the end type and daisy chain type wire harnesses.

The invention claimed is:

1. A manual machine for attaching an insulation displacement type connector comprising:

a base plate incorporated in a machine body and capable of sliding therein to reciprocate between an inoperative home position and a working position for attaching the connector, a connector rest fixed on the base plate, a housing stopper for positioning the connector lying on the rest, a housing holder for pressing the connector against the connector rest so as to hold the connector in place, a set block disposed adjacent to the rest such that a plurality of electric wires are capable of being positioned selectively with respect to their free ends or with respect to their middle portions, a wire holder disposed adjacent to the housing holder such that the wires to be attached to the connector are capable of being guided and held in place, while being arranged side by side at a prescribed given pitch, a wire stopper that is pivoted to the set block so as to swivel between an active position close to the set block and an idle position remote therefrom, and the wire stopper having a collision portion on which the wires will impinge at their free ends to be aligned one with another, and a biasing portion that will urge the wires at their middle portions towards the set block.

2. A manual machine as defined in claim 1, wherein the collision portion is formed as an array of flat wall zones of a front face of the wire stopper, and each wall zone is defined between adjacent two of notches carved side by side at the given pitch in the front face.

3. A manual machine as defined in claim 1, wherein the housing stopper is composed of a fixed shoe and a movable shoe so that the connector laid on the connector rest are protected from becoming out of order in position in the direction of the given pitch, the fixed shoe is secured to one of opposite side ends of the connector rest, with the movable shoe facing the fixed one and capable of sliding along a front face of the set block, and the movable shoe has a vertical ear protruding therefrom for selective engagement with one of vertical grooves that are formed side by side at the given pitch in the set block front face, such that the movable shoe is capable of being set at any desired incremental position correspondingly to the number of poles of the connector.

* * * * *